US008720692B2

(12) United States Patent
Apps

(10) Patent No.: US 8,720,692 B2
(45) Date of Patent: May 13, 2014

(54) PALLET

(75) Inventor: William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 1133 days.

(21) Appl. No.: 11/943,830

(22) Filed: Nov. 21, 2007

(65) Prior Publication Data

US 2009/0127158 A1 May 21, 2009

(51) Int. Cl.
*B65D 19/16* (2006.01)

(52) U.S. Cl.
USPC ..... 206/600

(58) Field of Classification Search
USPC ..... 206/600, 386, 599, 503, 509, 511, 512; 220/4.28, 4.2, 4
See application file for complete search history.

(56) References Cited

U.S. PATENT DOCUMENTS

| | | | | |
|---|---|---|---|---|
| 3,835,792 | A | 9/1974 | Wharton | |
| 4,674,647 | A * | 6/1987 | Gyenge et al. | 220/6 |
| 5,094,356 | A | 3/1992 | Miller | |
| 5,199,592 | A | 4/1993 | Reiland et al. | |
| 6,484,898 | B2 * | 11/2002 | Hillis et al. | 220/6 |
| 7,281,637 | B2 | 10/2007 | Hadar | |
| 2002/0070215 | A1 | 6/2002 | Walsh et al. | |
| 2004/0200833 | A1 * | 10/2004 | Dubois et al. | 220/6 |
| 2005/0150892 | A1 * | 7/2005 | Miller | 220/324 |
| 2006/0260976 | A1 | 11/2006 | Apps | |

FOREIGN PATENT DOCUMENTS

| | | |
|---|---|---|
| DE | 2 020 581 | 11/1971 |
| EP | 0 655 392 | 5/1995 |
| EP | 0 690 003 | 1/1996 |
| FR | 2 780 035 | 12/1999 |
| GB | 2 357 078 | 6/2001 |
| GB | 2 426 237 | 11/2006 |
| WO | 98/40199 | 9/1998 |
| WO | 00/48929 | 8/2000 |

OTHER PUBLICATIONS

European Search Report for EP Application No. 08169568.6, Mar. 9, 2009.
United Kingdom Search Report for UK Application No. GB0609645.7, Jul. 25, 2008.
United Kingdom Search Report for UK Application No. GB0609645.7, Aug. 3, 2006.

* cited by examiner

*Primary Examiner* — Steven A. Reynolds
*Assistant Examiner* — King M Chu
(74) *Attorney, Agent, or Firm* — Carlson, Gaskey & Olds, P.C.

(57) ABSTRACT

A collapsible bin includes a base having a floor from which a plurality of spaced apart columns extend downwardly. A plurality of walls are hingeably connected to an upper surface of the base. A lid is securely received on upper edges of the walls when the walls are in the erected position. The lid can also be secured to the base when the walls are in the collapsed position. The bin is securely stackable in the collapsed and erected positions, with and without lids.

19 Claims, 14 Drawing Sheets

PALLET

BACKGROUND OF THE INVENTION

The present invention relates generally to pallets, in more particularly to a collapsible pallet bin. A collapsible pallet bin is generally a pallet with collapsible upstanding walls.

Collapsible pallet bins typically include a base defining a floor of the bin. The base includes columns extending downwardly from the floor and defining openings therebetween for receiving the tines of a forklift. The bin further includes four collapsible walls extending upwardly from the base. The walls are connected to the base by hinges.

SUMMARY OF THE INVENTION

A collapsible bin includes a base having a floor from which a plurality of spaced apart columns extend downwardly. A plurality of walls are hingeably connected to an upper surface of the base. A lid is securely received on upper edges of the walls when the walls are in the erected position. The lid can also be secured to the base when the walls are in the collapsed position. The bin is securely stackable in the collapsed and erected positions, with and without lids.

These and other features of the application can be best understood from the following specification and drawings, the following of which is a brief description.

DETAILED DESCRIPTION OF THE PREFERRED EMBODIMENT

Figure 1:
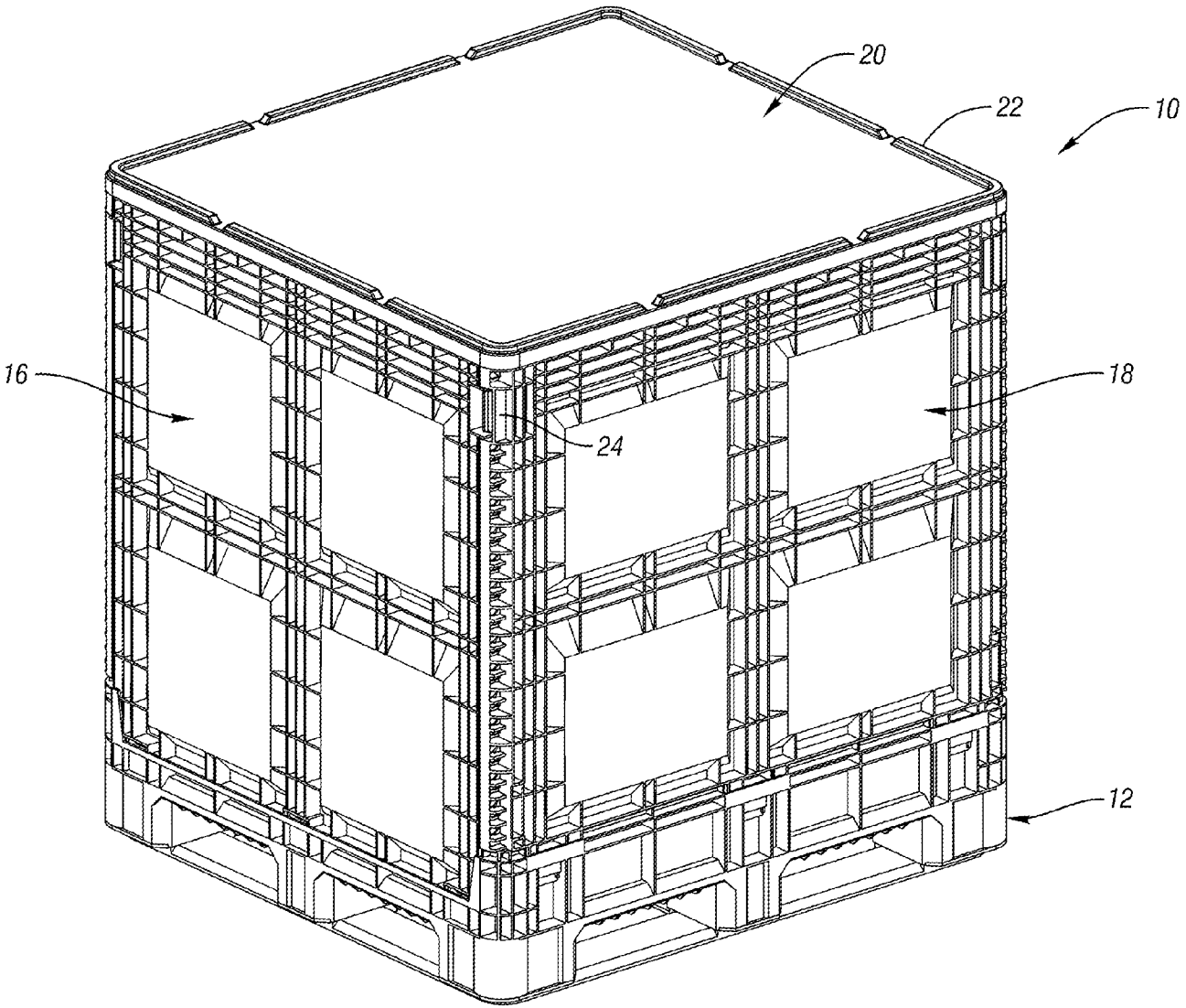
FIG. 1 is a perspective view of a bin according to one embodiment of the present invention.

A collapsible pallet bin 10 according to one embodiment of the present invention is shown in FIG. 1. The bin 10 includes a base 12 from which end walls 16 and side walls 18 extend upwardly. A lid 20 is removably secured to upper edges of the end walls 16 and side walls 18. The lid includes a split peripheral rib 22 protruding from an upper surface of the lid 20 around the periphery of the lid 20. As shown, the peripheral rib 22 may be segmented or discontinuous in order to permit water to run off. Latches 24 connect the end walls 16 to the side walls 18 near the corners of the bin 10.

Figure 2:
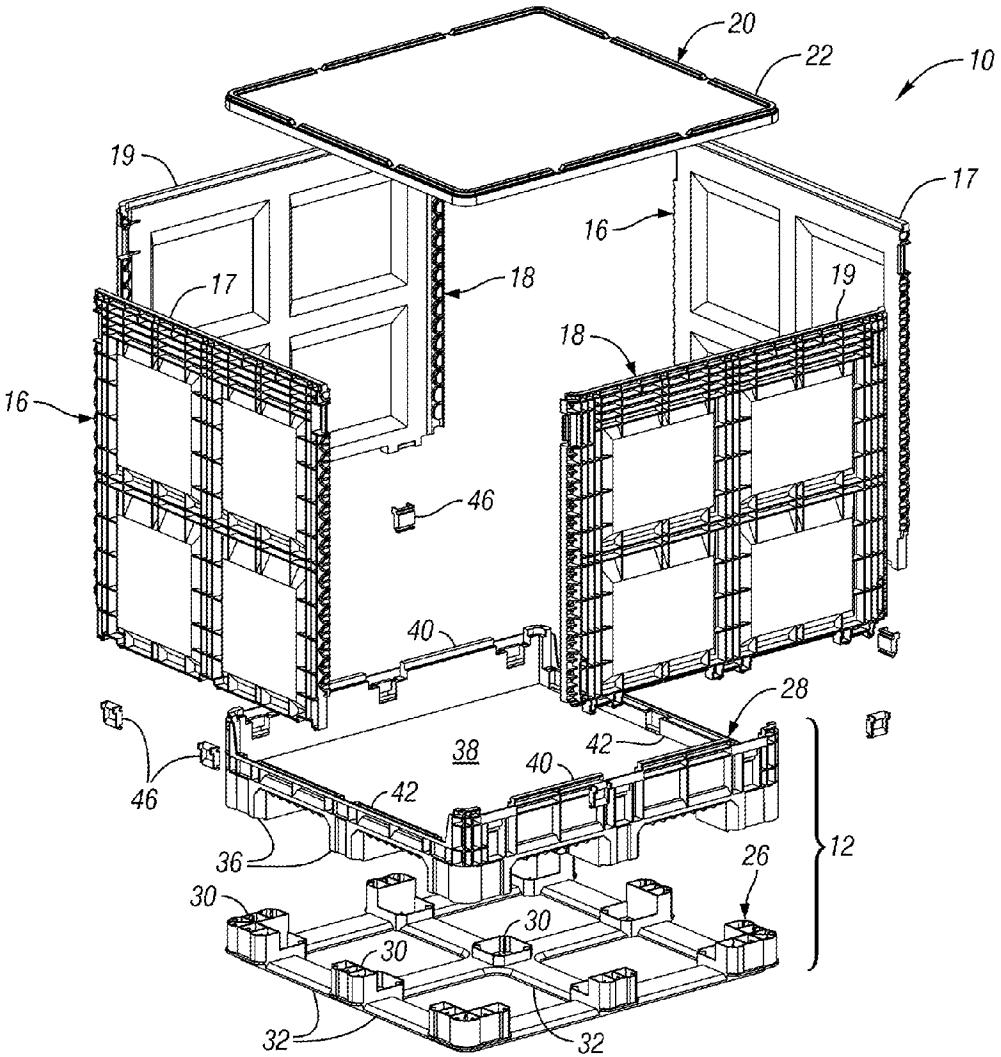
FIG. 2 is an exploded view of the bin of FIG. 1.

FIG. 2 is an exploded view of the bin 10 of FIG. 1. The base 12 includes a lower portion 26 and an upper portion 28. The lower portion 26 includes a plurality of lower column members 30 extending upwardly and interconnected by runners 32. The upper portion 28 includes a plurality of upper column members 36 extending downwardly from a floor 38. The upper column members 36 are slightly larger than the lower column members 30 such that the lower column members 30 can be slidably received and snap-fit into the upper column members 36.

The upper portion 28 further includes a pair of side flanges 40 extending upwardly from the side edges of the floor 38. End flanges 42 extend upwardly from end edges of the floor 38. The side flanges 40 are substantially taller than the end flanges 42. Hinges 46 hingeably connect the end walls 16 and side walls 18 to the flanges 42, 40, respectively. The upper edge of each end wall 16 includes a projection, such as a rail 17, that is slightly narrower than the overall thickness of the end walls 16. Similarly, the side walls 18 include a projection, such as a rail 19, on the upper edge thereof that is slightly narrower than the thicknesses of the sidewalls 18.

Figure 2A:
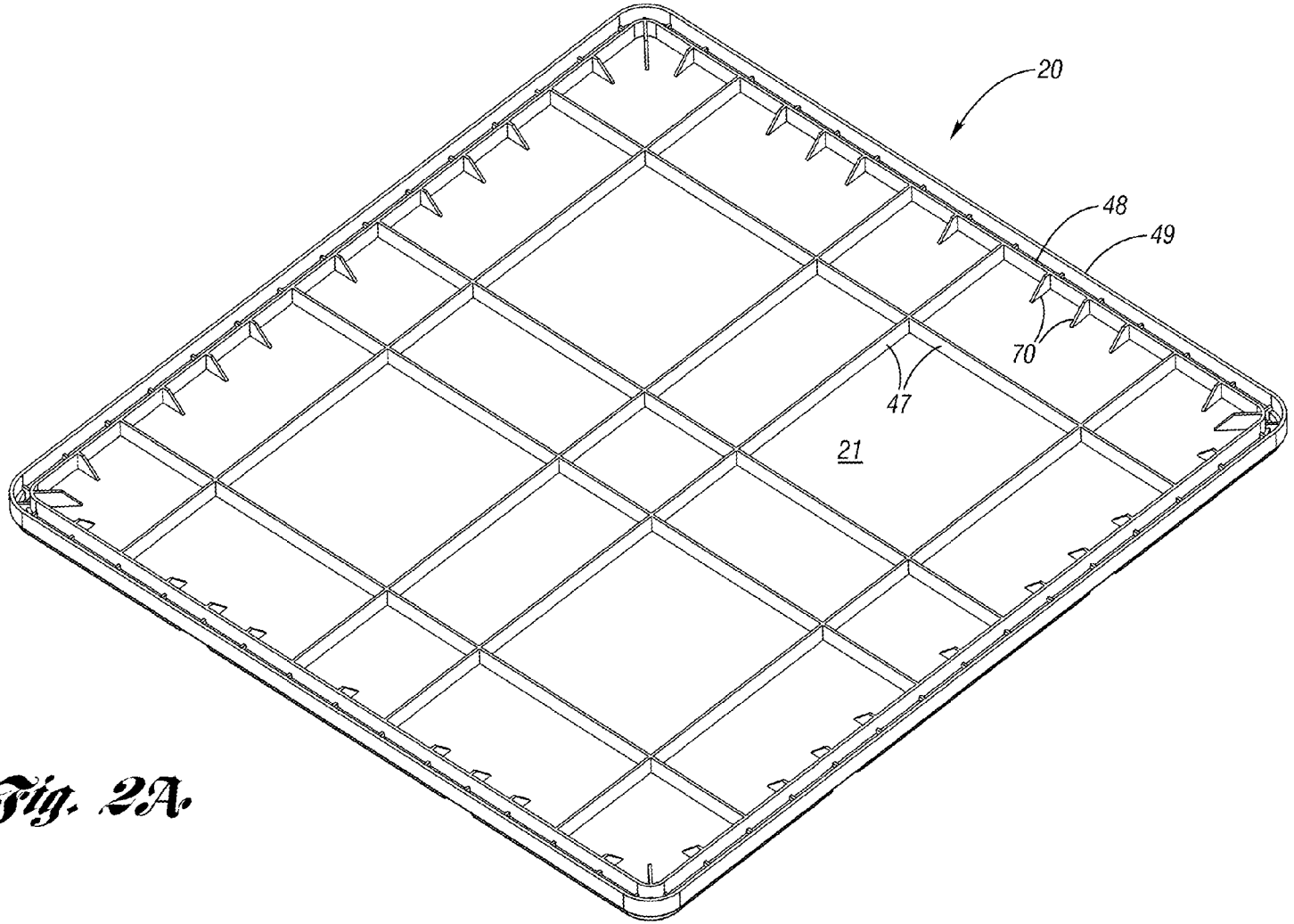
FIG. 2A is a bottom perspective view of the lid of FIG. 1.

FIG. 2A is a bottom perspective view of the lid 20. The lid 20 includes a planar portion 21 reinforced by a plurality of cross-ribs 47. An inner peripheral flange 48 and an outer peripheral flange 49 are spaced apart to define a peripheral recess 72. Gussets 70 extend from the planar portion 21 to the inner peripheral flange 48.

Figure 3:
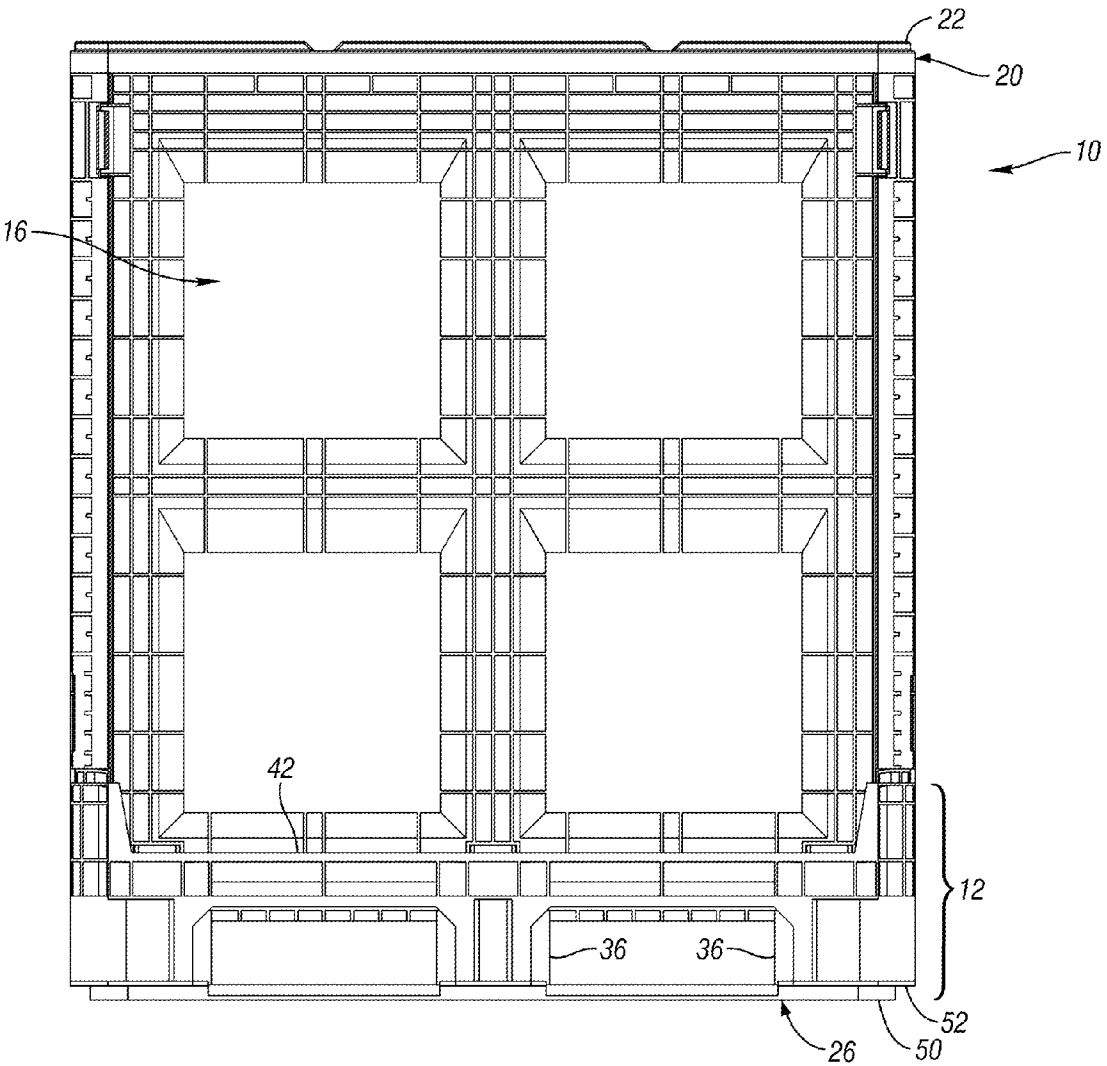
FIG. 3 is an end view of the bin of FIG. 1.

Referring to FIG. 3, the lower portion 26 of the base 12 includes a reduced footprint portion 50 forming a peripheral ledge 52. Also as can be seen in FIG. 3, the lid 20 fits over the rails 17, 18 of the end walls 16 and side walls 18.

Figure 4:
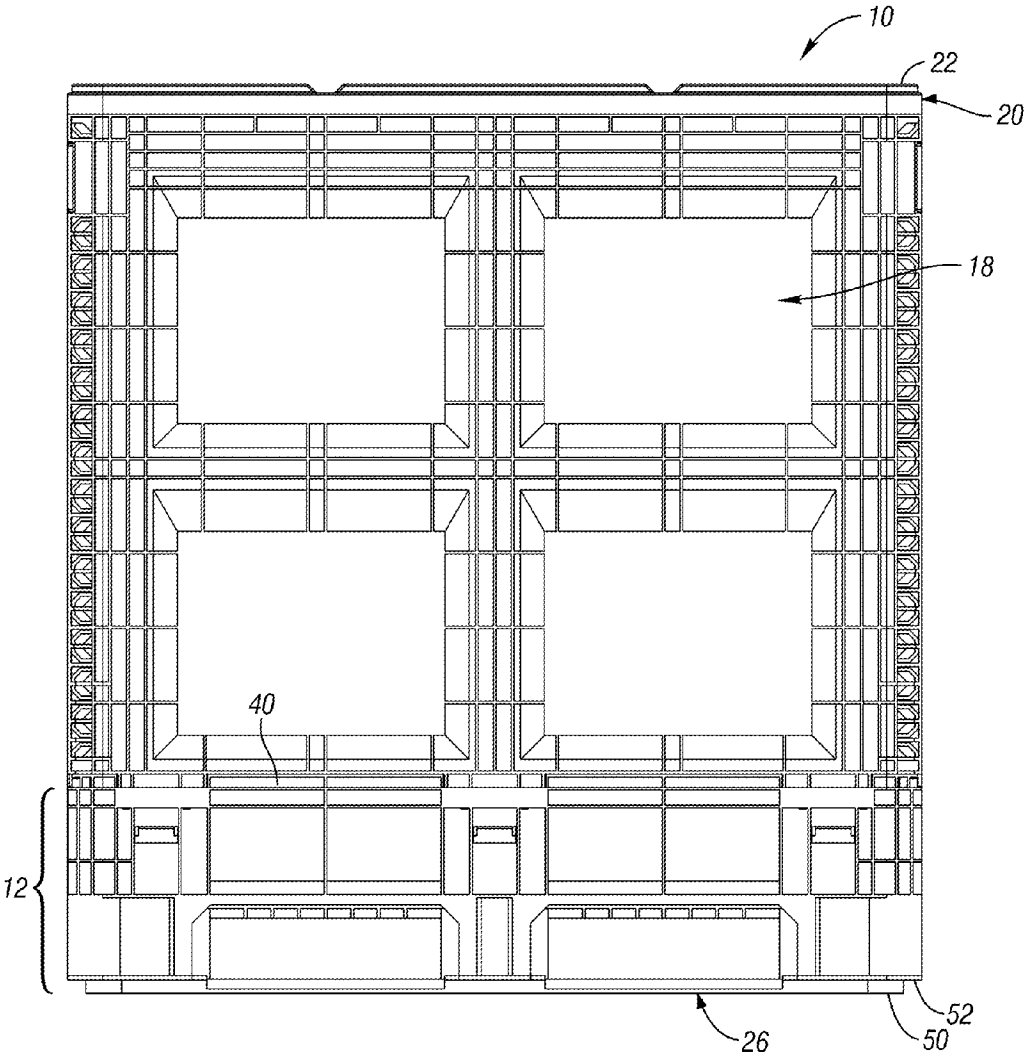
FIG. 4 is a side view of the bin of FIG. 1.

The peripheral ledge 52 is also shown in FIG. 4, which is a side view of the bin 10. As shown, the ledge 52 extends around the periphery of the bin 10 on both sides and both ends.

Figure 5A:
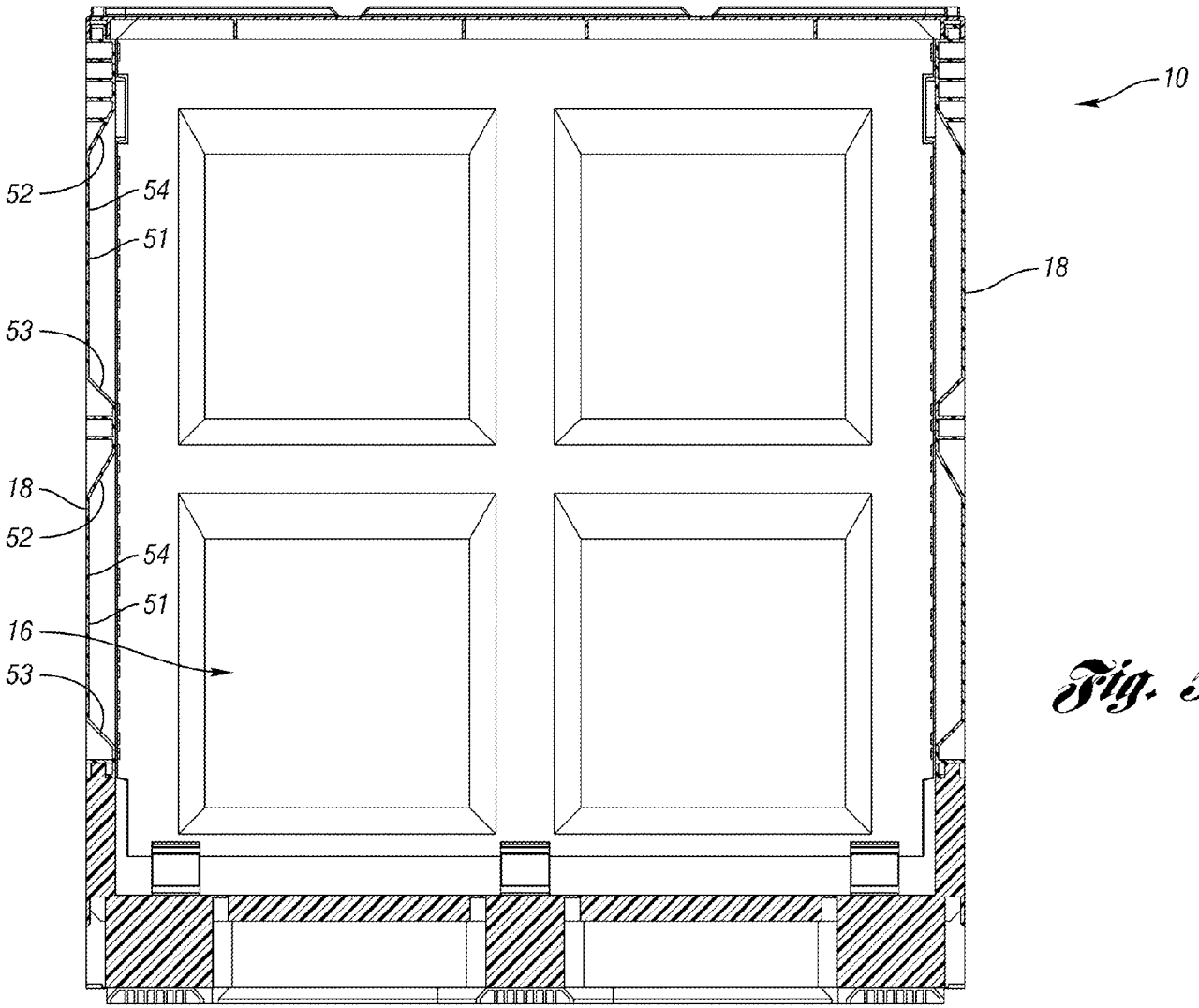
FIG. 5A is a section view of the bin of FIG. 1.

FIG. 5A is a section view through the bin 10. The side walls 18 each include interior recesses 51 having an upper angled surface 52 and a lower angled surface 53. The lower angled surface 53 is angled approximately 135 degrees relative to the vertical portion 54 of the recess 51. The upper angled surface 52 is angled approximately 150 degrees relative to the vertical portion 54 of the recess 51. In use, the bin 10 may be rotated to an angle approximately 45 degrees from completely inverted (i.e., rotated about 135 degrees) by automated handling equipment, in order to empty the contents. In order to ensure that all contents are emptied from the bin 10, the upper angled surfaces 53 is angled more than 135 degrees—in this example, approximately 150 degrees—to ensure that the upper angled surfaces 53 will be pitched downwardly in this position.

Figure 5B:
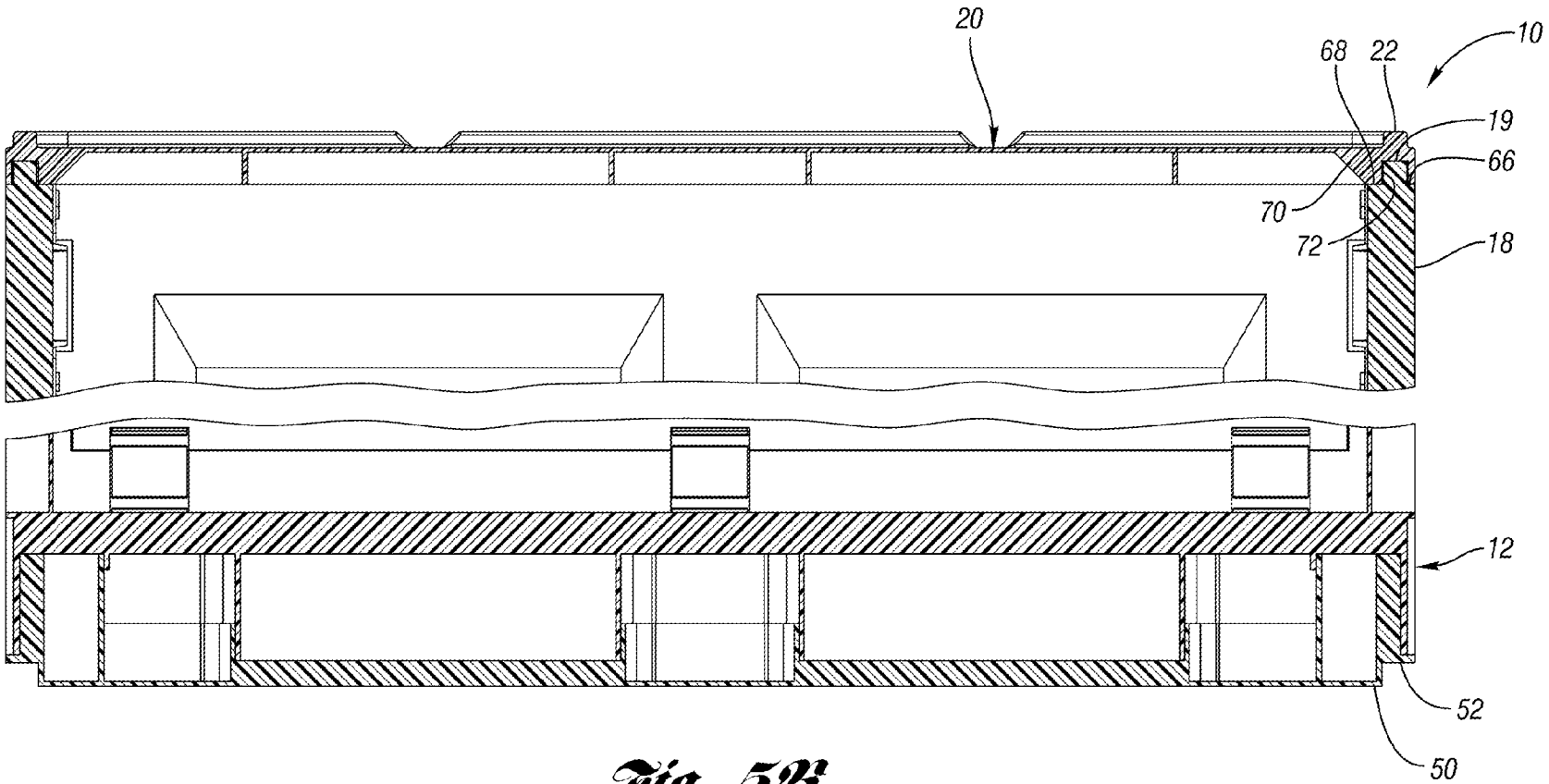
FIG. 5B is an enlarged view of the upper and lower portions of the collapsible pallet bin of FIG. 1.

FIG. 5B is an enlarged section view of the upper edge and lower portion of the bin 10. The rail 19 on the upper edge of the side wall 18 is narrower than the nominal thickness of the side wall 18. The rail 19 is spaced inwardly from the exterior and interior surfaces, such that an exterior ledge 66 and interior ledge 68 are formed on either side of the rail 19. The peripheral recess 72 of the lid 20 is generally in alignment with the peripheral rail 22 on the upper surface of the lid 20. The lid 20 is installed on the bin 10 with the rails 19 received in the recess 72 in the lid 20. Simultaneously, the rails 17 on the end walls 16 would also be received in the recess 72 of the lid 20. The inner ledge 68 on the upper edge of the side walls 18 is generally aligned with the reduced footprint portion 50. In other words, the distance between the rails 19 on opposing side walls 18 is sufficient to accommodate the reduced footprint 50, while the rails 19 are generally vertically aligned with the peripheral ledge 52. This is also true of the rails 17 on the end walls 16.

Figure 6:
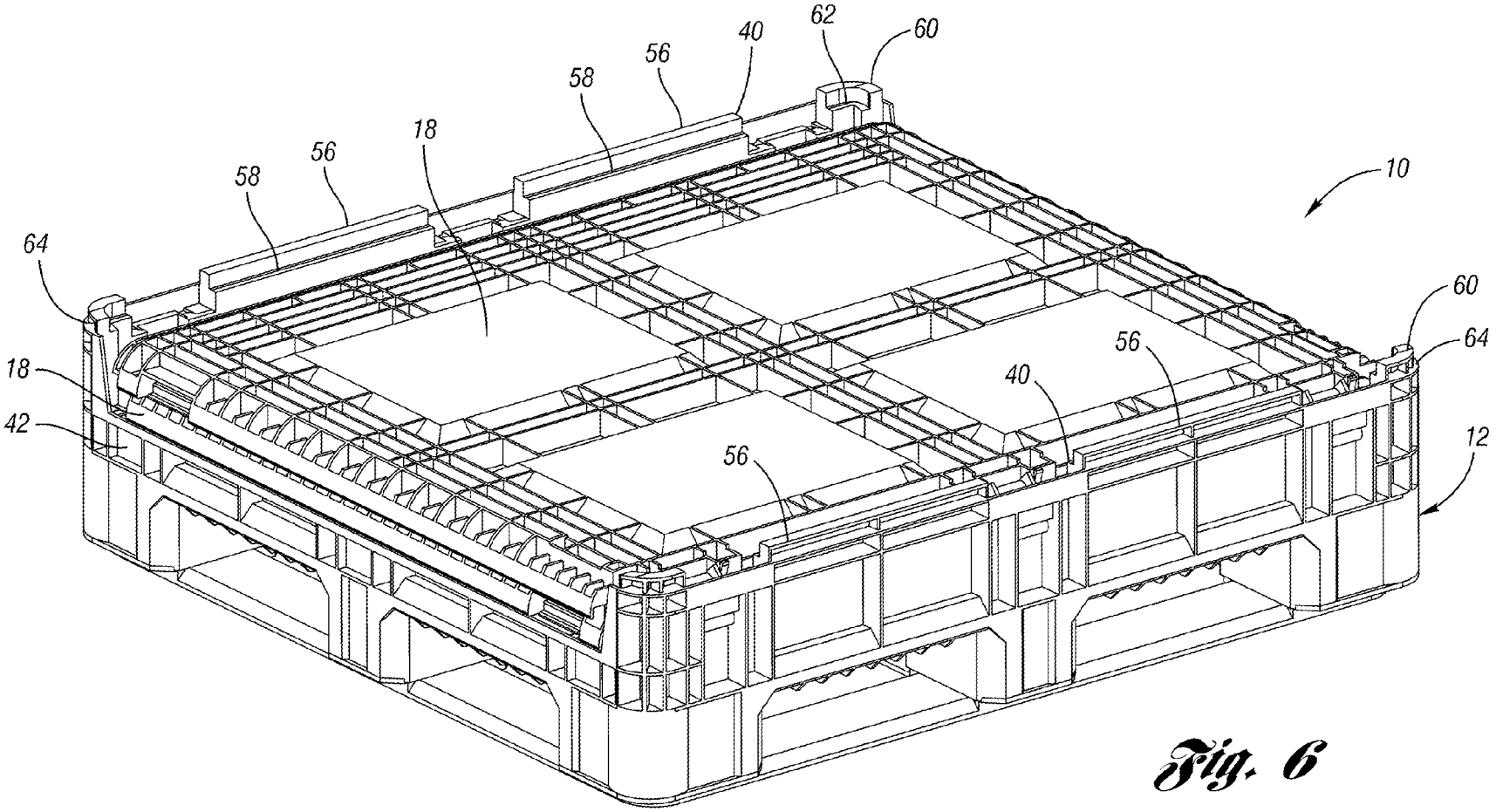
FIG. 6 is a perspective view of the bin of FIG. 1 in a collapsed position.

FIG. 6 illustrates the bin 10 in the collapsed position, wherein the end walls 16 are collapsed onto the base 12 (and one another), and one of the side walls 18 is collapsed on the end wall 16, while the other side wall 18 is collapsed on top of the first side wall 18. Each side flange 40 of the base 12 includes a pair of spaced apart projections, such as side rails 56, each having a side interior ledge 58 formed inwardly thereof. Each side flange 40 further includes a pair of corner projections, such as corner rails 60, having an interior corner ledge 62 formed inwardly thereof and an exterior corner ledge 64 formed outwardly thereof. The distances between side rails 56 on opposing side flanges 40 and the distances between opposed corner rails 60 are sufficient to accommodate the reduced footprint portion 50 (FIG. 5) of the base 12, while the adjacent ledges 58, 62 would support the reduced footprint portion 50.

Figure 7:
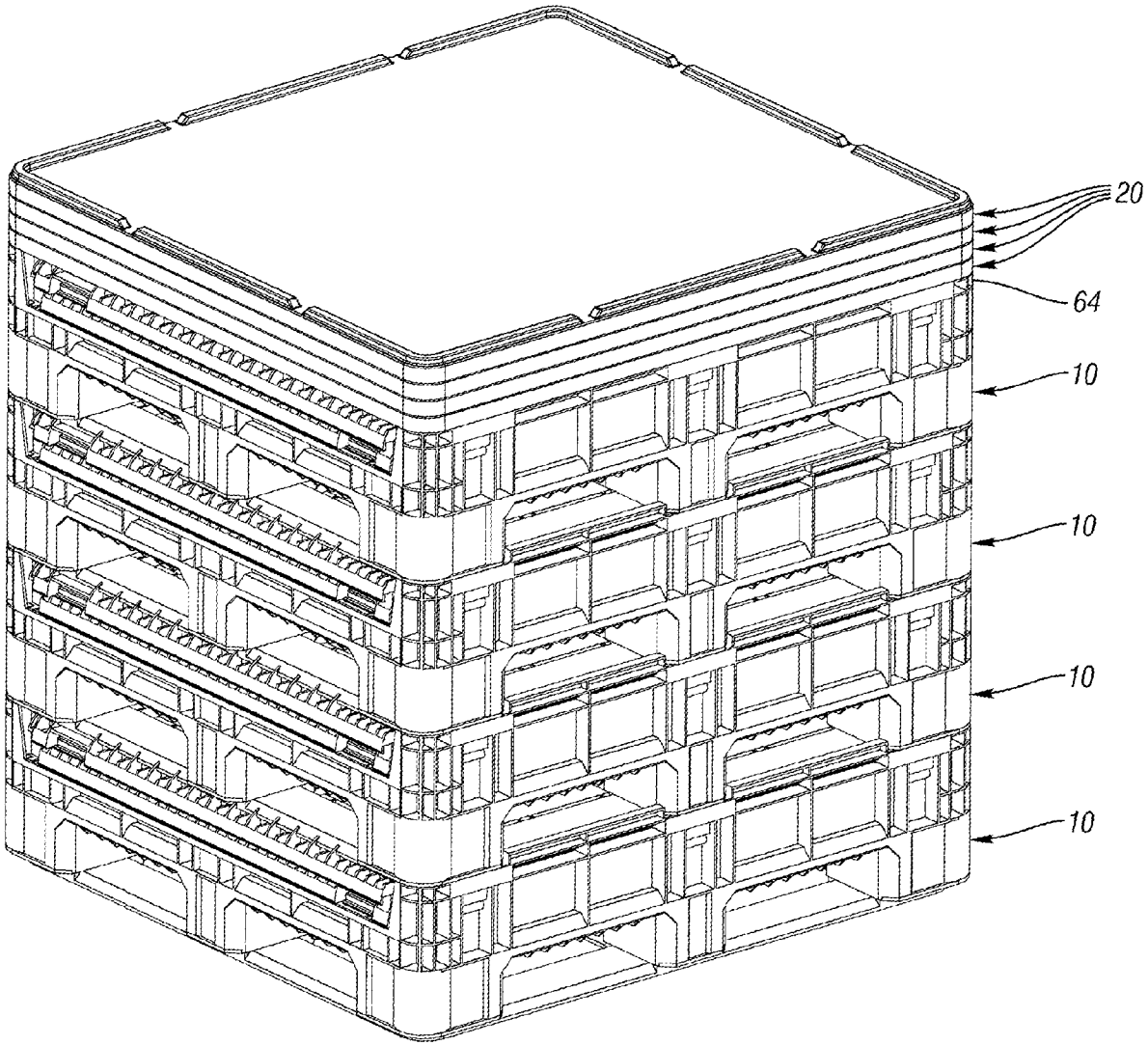
FIG. 7 illustrates a plurality of the collapsed bins of FIG. 6 stacked upon one another and with a plurality of lids stacked thereon.

As shown in FIG. 7, multiple collapsed bins 10 can be supported on one another as shown. Further, multiple lids 20 can be stacked on one another, as well as on a collapsed bin 10.

Figure 8:
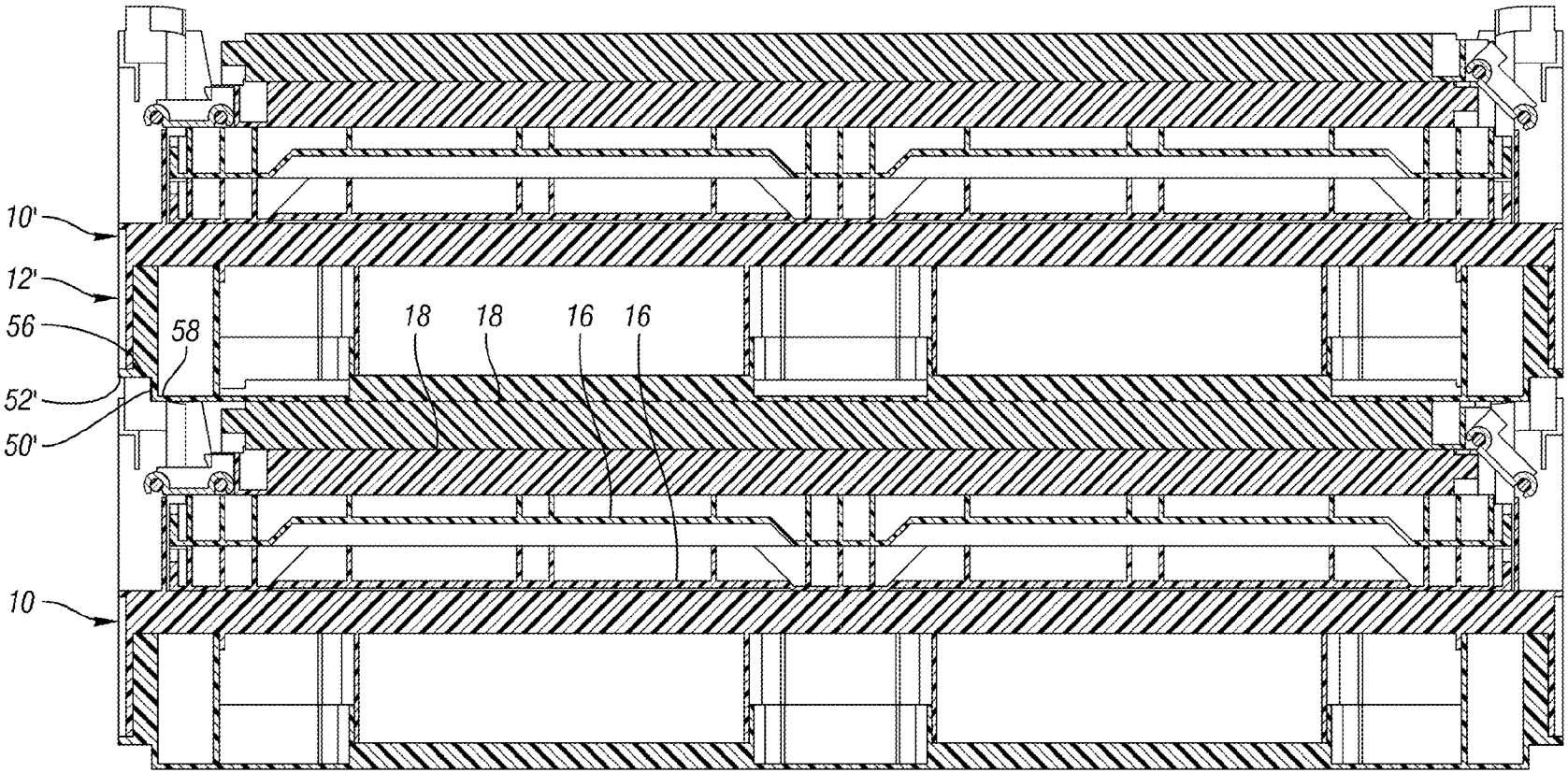
FIG. 8 is a section view through two stacked bins.

FIG. 8 is a section view through two stacked collapsed bins 10, 10'. The peripheral ledge 52' of the base 12' of the upper bin 10' is supported on the side rails 56 (and corner rails 60—FIG. 6) and the base 12' of the upper bin 10' is supported on the collapsed walls 16, 18 of the lower bin 10. The reduced footprint portion 50' of the upper bin 10' is received between the side rails 56 (and between the corner rails 60), and the reduced footprint portion 50' of the upper bin 10' is supported on the ledges 58 (and ledges 62). The side walls 18 and end walls 16 all lie flat on one another and on the base 12 because of the double hinges 46. As a result, the overall height of the collapsed bins 10, 10' is as low as possible. Further, the load transfer of the walls 16, 18 to one another and from the upper bin 10' to the lower bin 10 is very even and balanced.

Figure 9:
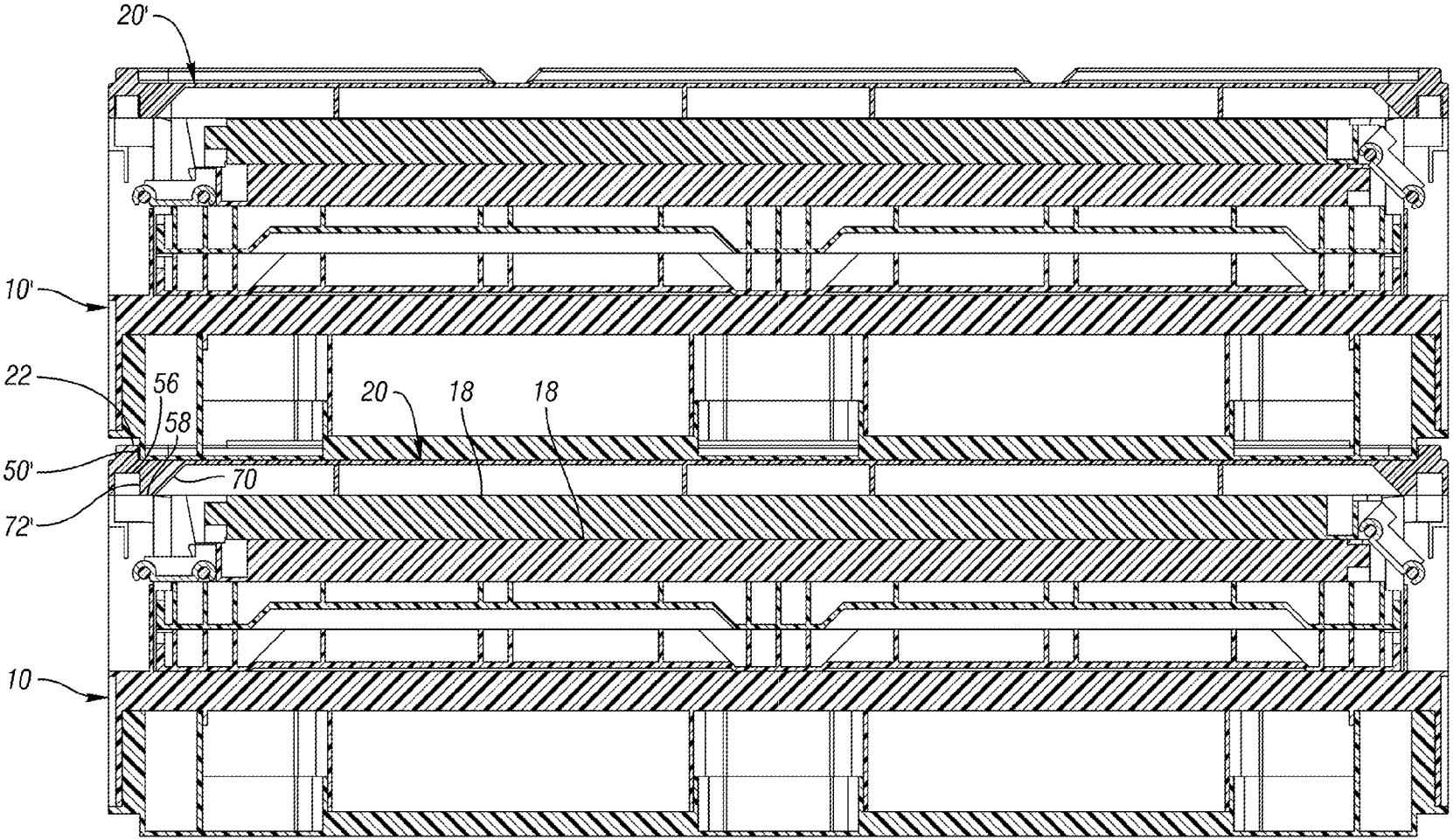
FIG. 9 is a section view through two stacked collapsed bins with lids.

FIG. 9 illustrates the bins of FIG. 8 with their associated lids 20 fitted thereon. Again, the rails 56 are received in the recesses 72 of the lids 20. The reduced footprint portion 50' of the upper bin 10' is received between opposing portions of the peripheral rail 22 of the lid 20 and the reduced footprint portion 50' is supported on the lid 20, which transfers load directly through the inner peripheral flange 48 and gussets 70 of the lid 20 directly to the ledge 58 (and ledge 62 in the corners). Thus, the collapsed bins 10, 10' can be securely stacked with lids (FIG. 9) or without lids 20 (FIG. 8).

Figure 10:
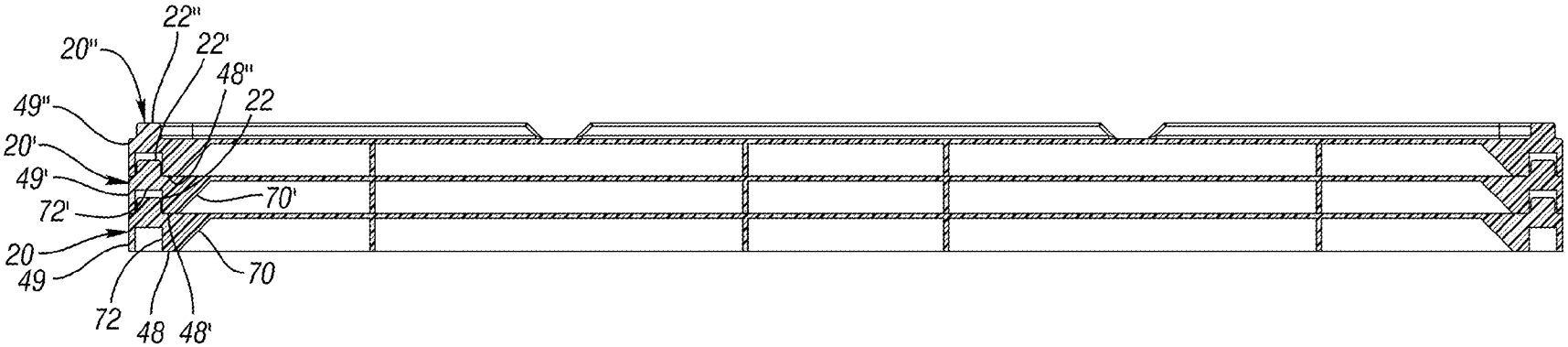
FIG. 10 is a section view through three stacked lids.

As shown in FIG. 10, a plurality of lids 20, 20', 20" can be stacked on one another as well. The peripheral rails 22 of each lid 20 is snugly received within the recess 72 of the lids stacked thereon. The inner peripheral flanges 48, outer peripheral flanges 49 and gussets 70 of each of the lids 20 transfer the weight of the lids 20 above it directly to one another and then to the floor.

Figure 11:
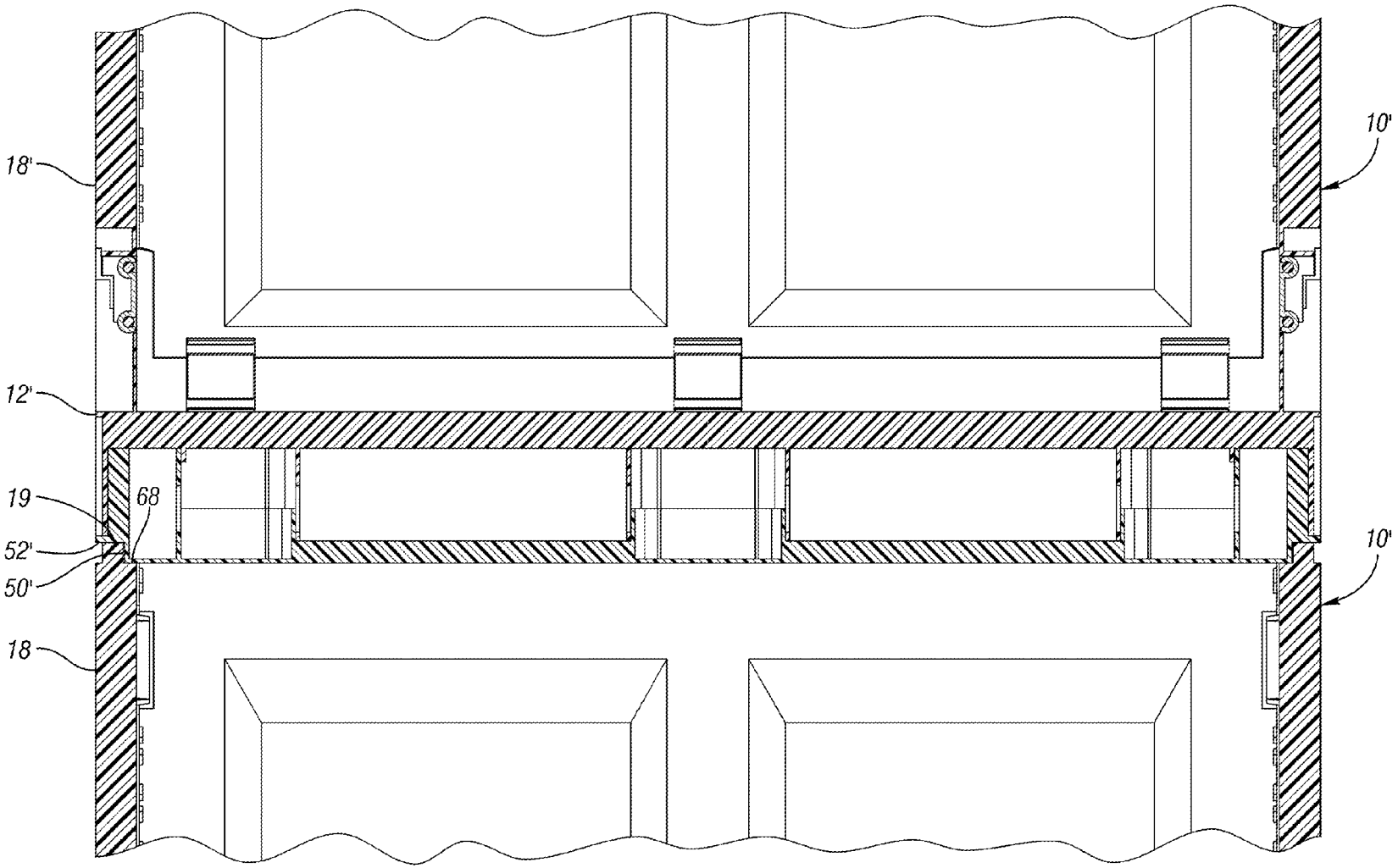
FIG. 11 is a section view through the engaging portions of two stacked erected bins.

FIG. 11 is a section through two stacked erected bins 10, 10', showing the upper portion of the lower bin 10 and the lower portion of upper bin 10'. As shown, the upper bin 10' can be securely stacked on the lower bin 10 without a lid 20 on the lower bin 10. The reduced footprint portion 50' is supported on the inner ledge 68 of the side walls 18 (and on a similar ledge inwardly of the rails 17 on end walls 16 (FIG. 2)). The peripheral ledge 52' of the upper bin 10' is supported on the rails 19 of the side walls 18 (and the rails 17 of the end walls 16—FIG. 2).

Figure 12:
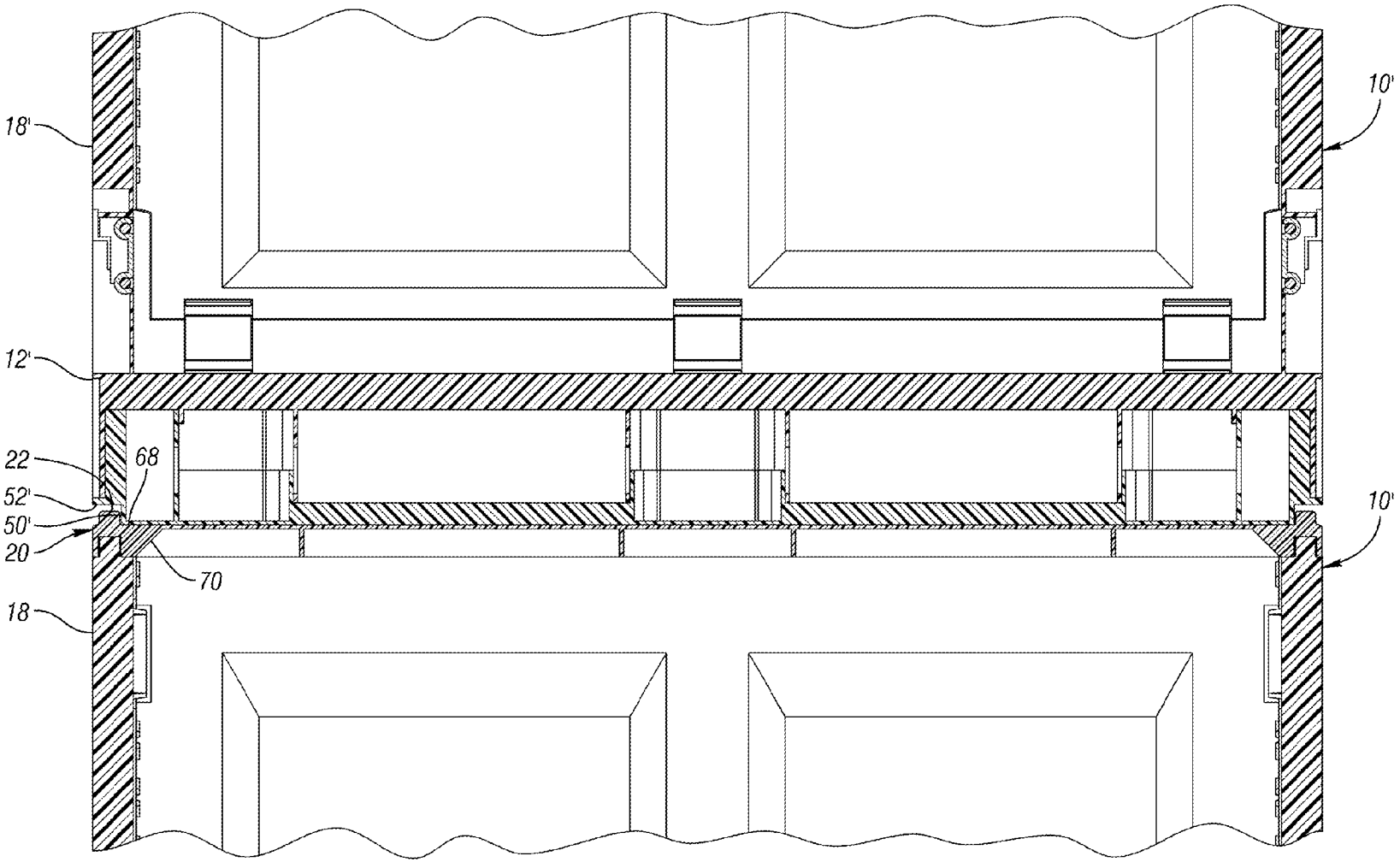
FIG. 12 is a section view similar to FIG. 11 with a lid on the lower bin.

The upper bin 10' can also be stacked on the lower bin 10 when the lower bin 10 has a lid 20, as shown in FIG. 12. The reduced footprint portion 50' of the upper bin 10' is supported on the lid 20, which transfers load directly through inner peripheral flange 48 and gussets 70 to the inner ledge 68 on the upper edge of side walls 16 (and to the upper edges of end walls 16). Thus, the bins 10, 10' can be stacked with lids securely.

As demonstrated above, the bin 10 can be stacked securely with identical bins in the collapsed position with or without lid 20 and in the upright position with or without a lid 20. The lids 20 are also stackable securely on one another.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A pallet comprising:

a floor;

a plurality of supports extending downwardly from the floor;

a reduced footprint portion below the supports;

a pair of flanges extending upwardly from opposite edges of the floor, each flange including at least three spaced apart projections on an upper edge thereof, each of the projections defining a respective interior ledge; and a wall pivotably connected to each of the flanges, each wall pivotable between an upright position and a collapsed position relative to the floor, wherein the reduced footprint portion is dimensioned such that the reduced footprint portion of an identical pallet can be supported on the interior ledges of the flanges, and such that a peripheral ledge of the reduced footprint portion of the identical pallet can be supported on the upper surface of the projections when the walls are in the collapsed position.

2. The pallet of claim 1 further including a removable lid securable to upper ends of the walls in the upright position and securable to the flanges when the walls are in the collapsed position.

3. The pallet of claim 2 wherein the lid includes a plurality of peripheral projections dimensioned to receive the reduced footprint portion of the identical pallet therebetween.

4. The pallet of claim 1 wherein the walls are entirely below a plane defined by uppermost edges of the flanges when the walls are in the collapsed position.

5. The pallet of claim 4 wherein the walls are a first pair of walls, the pallet further including a second pair of walls transverse to the first pair of walls, the second pair of walls movable between an upright position and a collapsed position on the floor.

6. A container comprising:

a base having a reduced footprint portion;

a pair of flanges extending upwardly from opposite edges of the base;

a pair of first walls each pivotably connected to one of the flanges, each first wall pivotable between an upright position and a collapsed position on the base;

wherein the reduced footprint portion is dimensioned such that an identical container can be supported on the first walls of the container when the first walls are in the upright position with the reduced footprint portion of the identical container between upper edges of the first walls; and a lid having a pair of recesses formed in a lower surface thereof, the recesses being configured to receive the upper edges of the first walls when the first walls are in the upright position, and the recesses further being configured to receive the pair of flanges when the first walls are in the collapsed position.

7. The container of claim 6 further including a first projection projecting from each of the upper edges of the first walls, the recesses in the lower surface of the lid receiving the first projections when the first walls are in the upright position.

8. The container of claim 7 further including a flange projection from upper edges of each of the flanges, the recesses in the lower surface of the lid receiving the flange projections when the first walls are in the collapsed position.

9. The container of claim 8 wherein the first and second walls are entirely below a plane defined by uppermost edges of the flanges when the first and second walls are in the collapsed position.

10. The container of claim 6 wherein the flanges include corner projections, recesses in the lower surface of the lid receiving the corner projections when the first and second walls are in the collapsed position.

11. The container of claim 6 further including that when the recesses of the lid receive the pair of flanges the lid is configured to receive the reduced footprint portion of an identical pallet thereupon.

12. The container of claim 7 wherein each first projection is in the form of a rail.

13. The container of claim 12 wherein the upper edge of each of the first walls defines an interior ledge formed inwardly from the rail and an exterior ledge formed outwardly from the rail.

14. The container of claim 13 wherein the recesses formed on the lower surface of the lid are capable of simultaneously receiving the interior and exterior ledges when the first and second walls are in the upright position.

15. The container of claim 7 wherein each first projection extends substantially along the entire length of the upper edge of a respective first wall.

16. The container of claim 6 wherein a rib is formed on an upper surface of the lid, the rib capable of receiving a reduced footprint portion of an identical container.

17. The container of claim 6 wherein the lid is configured to nest with an identical lid.

18. The pallet of claim 1, wherein at least three spaced apart projections includes a pair of spaced apart corner projections and at least one rail disposed between the corner projections, the at least one rail spaced apart from each of the corner projections.

19. The pallet of claim 18, wherein the at least one rail includes two spaced apart rails.

* * * * *

UNITED STATES PATENT AND TRADEMARK OFFICE

CERTIFICATE OF CORRECTION

PATENT NO. : 8,720,692 B2
APPLICATION NO. : 11/943830
DATED : May 13, 2014
INVENTOR(S) : Apps It is certified that error appears in the above-identified patent and that said Letters Patent is hereby corrected as shown below:

IN THE CLAIMS:

Claim 9, column 5, line 12: remove “and second”

Claim 10, column 5, line 18: remove “and second”

Claim 14, column 6, line 7: remove “and second”

Signed and Sealed this
Eighth Day of July, 2014

Michelle K. Lee

Michelle K. Lee
*Deputy Director of the United States Patent and Trademark Office*